US010947790B2

(12) United States Patent
Alexander et al.

(10) Patent No.: US 10,947,790 B2
(45) Date of Patent: Mar. 16, 2021

(54) COILED TUBING CONNECTOR WITH INTERNAL ANCHOR AND EXTERNAL SEAL

(71) Applicant: Baker Hughes, a GE company, LLC, Houston, TX (US)

(72) Inventors: David A. Alexander, Houston, TX (US); Levi B. Oberg, Houston, TX (US); Erik van Steveninck, Houston, TX (US); Brian Voisin, Spring, TX (US); David C. Johnson, Conroe, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/714,699

(22) Filed: Dec. 14, 2019

(65) Prior Publication Data

US 2020/0115966 A1 Apr. 16, 2020

Related U.S. Application Data

(63) Continuation-in-part of application No. 15/726,020, filed on Oct. 5, 2017, now abandoned.

(51) Int. Cl.

| | |
|---|---|
| ***E21B 17/046*** | (2006.01) |
| ***E21B 17/02*** | (2006.01) |
| ***E21B 19/00*** | (2006.01) |
| ***E21B 23/00*** | (2006.01) |
| ***E21B 17/00*** | (2006.01) |
| ***E21B 17/20*** | (2006.01) |

(52) U.S. Cl.

CPC ..... *E21B 17/046* (2013.01); *E21B 17/00* (2013.01); *E21B 17/02* (2013.01); *E21B 17/023* (2013.01); *E21B 17/20* (2013.01); *E21B 19/00* (2013.01); *E21B 23/00* (2013.01)

(58) Field of Classification Search

CPC ..... E21B 17/00; E21B 23/00; E21B 17/046; E21B 17/20; E21B 17/023; E21B 17/02; E21B 19/00

See application file for complete search history.

(56) References Cited

U.S. PATENT DOCUMENTS

| | | | |
|---|---|---|---|
| 4,289,200 | A | 9/1981 | Fisher, Jr. |
| 5,704,393 | A | 1/1998 | Connell et al. |
| 6,457,520 | B2 | 10/2002 | Mackenzie et al. |
| 6,712,150 | B1 | 3/2004 | Misselbrook et al. |
| 8,281,851 | B2 | 10/2012 | Spence |

(Continued)

FOREIGN PATENT DOCUMENTS

| | | | |
|---|---|---|---|
| CN | 202338212 | U | 7/2012 |
| EP | 0681085 | A2 | 8/1995 |
| WO | 01/09543 | A1 | 8/2001 |

*Primary Examiner* — Tara Schimpf
*Assistant Examiner* — Manuel C Portocarrero
(74) *Attorney, Agent, or Firm* — Shawn Hunter

(57) ABSTRACT

A connector for a coiled tubing end anchors internally and seals externally. The anchor profile is split with a gap to clear an internal spline without need to remove the spline to allow a seal to enter the coiled tubing since the seal is mounted internally to a sleeve that envelops the end of the coiled tubing. Component relative rotation extends the internal anchor radially against the coiled tubing inner wall to secure the connection with the seal engaged to the coiled tubing outer wall.

13 Claims, 4 Drawing Sheets

(56) References Cited

U.S. PATENT DOCUMENTS

| | | | | |
|---|---|---|---|---|
| 2003/0230893 | A1* | 12/2003 | Song | E21B 19/086 285/39 |
| 2004/0084191 | A1 | 5/2004 | Laird | |
| 2008/0047716 | A1* | 2/2008 | McKee | E21B 17/046 166/384 |
| 2011/0024133 | A1 | 2/2011 | Sach | |
| 2011/0284224 | A1 | 11/2011 | Misselbrook et al. | |
| 2012/0298376 | A1 | 11/2012 | Twardowski | |
| 2013/0076025 | A1 | 3/2013 | Gipson et al. | |
| 2015/0060087 | A1 | 3/2015 | Schultz et al. | |

* cited by examiner

COILED TUBING CONNECTOR WITH INTERNAL ANCHOR AND EXTERNAL SEAL

FIELD OF THE INVENTION

The field of the invention is connectors for connecting a tool to coiled tubing and more particularly where the anchor is internal to the coiled tubing and the seal is external to the coiled tubing.

BACKGROUND OF THE INVENTION

Various tools need to be connected to coiled tubing for a variety of operations downhole. In the past the connection included an anchor and a seal. Most coiled tubing has an internal weld bead akin to an axial spline that extrudes from the internal diameter of the tubing. FIG. 1 indicates an end of such spline 10 pointed out by arrow 12. In order to seal to the inside wall 14 of the coiled tubing end the spline 10 had to be ground off. In the smaller coiled tubing sizes this required use of small grinding and buffing tools to prepare an internal wall to be free of burrs or protrusions. Inspection of the prepared surface was also problematic particularly in the small sizes. Despite these challenges, those skilled in the art continued to fabricate the connector male end with a seal to fit into the coiled tubing end after all the surface preparation issues described above.

One such design is US 2015/0060087 where the seal is 26 on the male end of the connector 18. The outer surface of the male end has recesses so that the coiled tubing 12 can be deformed into the recesses 42 for the physical connection as the seal 26 came into contact with the inside wall of the coiled tubing end 12 after the inside wall of the coiled tubing end was prepared to accept the seal 26 in this reference by the elimination of the spline 10 shown in FIG. 1 herein.

FIG. 2 shows another connector male end that has a seal 20 adjacent a wedge 22. The gripping member 24 has circumferential wickers 26 spaced apart from axial wickers 28 by a groove 30. The illustrated male end needs to be inserted into the end of the coiled tubing. Translation of ring 32, caused by rotation of an adjacent part with respect to the mandrel, advances it to the left with ramp 34 to push out gripping member 24. A set screw 36 in actuator ring 60 (shown in FIG. 3) prevents movement to the right of the ramp 34 to hold the gripping position on the interior wall of the coiled tubing that is not shown. Actuation of the gripping member also axially compresses the seal into contact with the surrounding coiled tubing interior wall. The same internal wall preparation of the coiled tubing end described above plagues this design.

What is needed is a way to obtain a seal to the coiled tubing end while eliminating the preparation work of the internal wall of the coiled tubing end. That preparation is time consuming and costly and still exposes the seal that has to be inserted internally to potential damage from burrs or any other internal imperfections that remain from the internal preparation work before making the connection.

Also relevant to coiled tubing connections are U.S. Pat. Nos. 6,712,150 and 8,281,851.

SUMMARY OF THE INVENTION

A connector for a coiled tubing end anchors internally and seals externally. The anchor profile is small enough to clear an internal spline without need to remove the spline to allow a seal to enter the coiled tubing since the seal is mounted internally to a sleeve that envelops the end of the coiled tubing. Component relative rotation extends the internal anchor radially against the coiled tubing inner wall to secure the connection with the seal engaged to the coiled tubing outer wall. The connector includes a split lock ring in which the split will straddle the spline when the end sub of the connector is inserted into the coiled tubing end. The lock ring is then expanded radially toward the interior surface of the coiled tubing end to lock the connector within the coiled tubing end.

DETAILED DESCRIPTION OF THE PREFERRED EMBODIMENT

Figure 1:
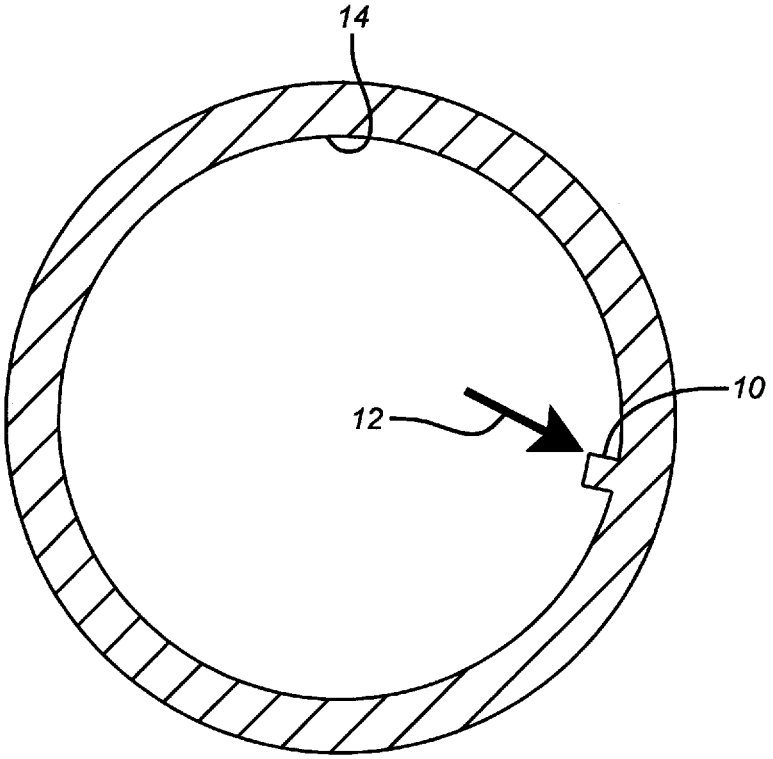
(PRIOR ART) FIG. 1
FIG. 1 is a prior art end view of coiled tubing showing a spline that needed to be removed to attach prior connectors.
Figure 2:
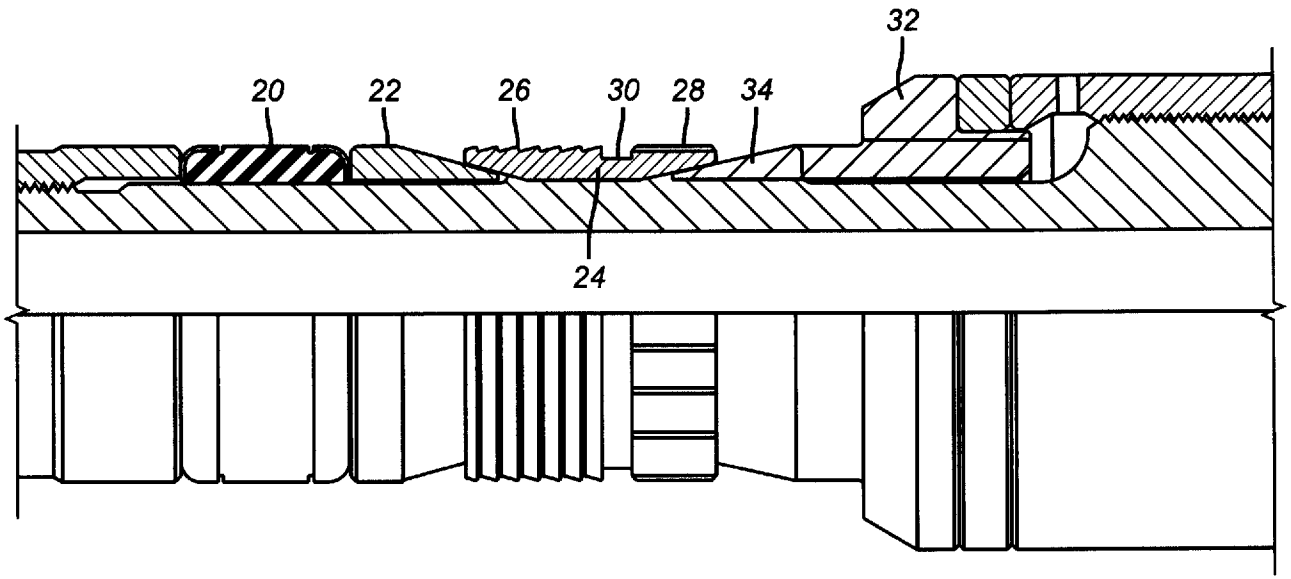
(PRIOR ART) FIG. 2
FIG. 2 is a part section view of a prior art design with the seal and grip device on the male end of the connector for insertion into the coiled tubing end.
Figure 3:
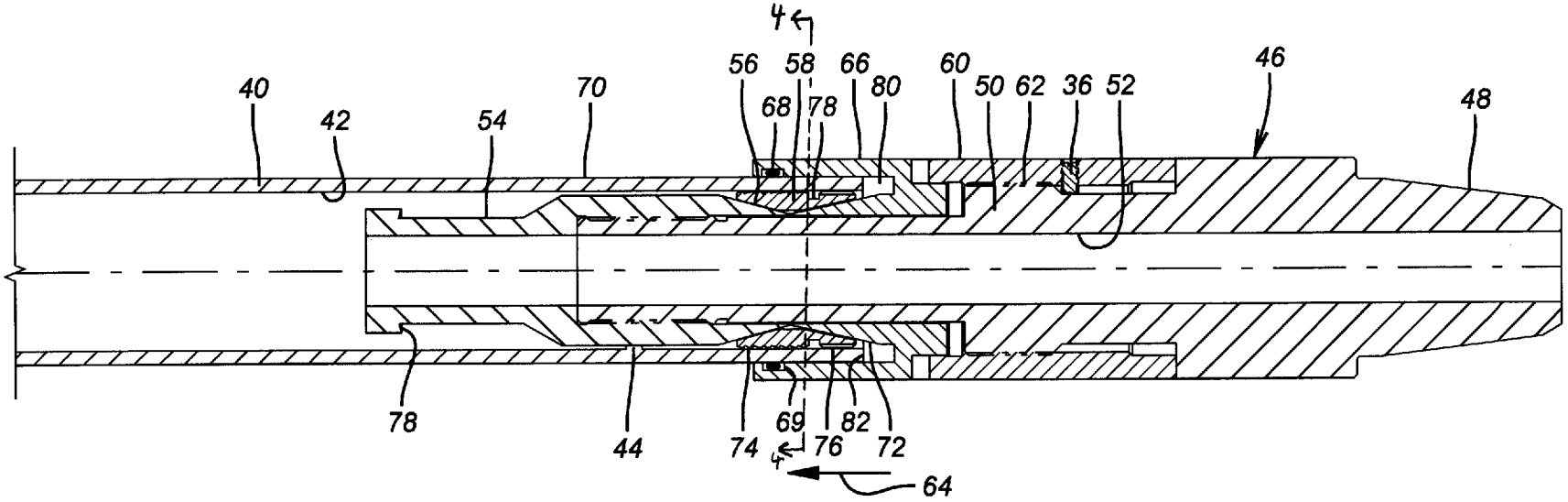
FIG. 3 is a section view of a connector attached to a coiled tubing end with an exterior seal.
Figure 4:
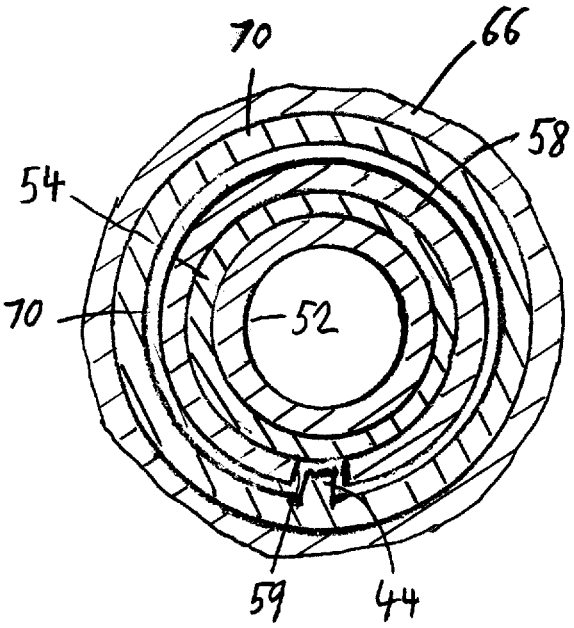
FIG. 4 is a cross-sectional view taken along lines 4-4 in FIG. 3.

Referring to FIGS. 3 and 4, a coiled tubing end 40 has an interior wall 42 which can have an internal axial spline shown schematically and in part as 44. The spline 44 extends axially along the interior surface of the coiled tubing end 40 in the same manner as the spline 10 discussed earlier. The male connector is shown as an assembly 46 further comprising an end thread 48 for connecting a tool that is not shown. The assembly 46 comprises a mandrel 50 having a through passage 52. An end sub 54 has a taper 56 against which rides a split lock ring 58. As shown by FIG. 4, the split lock ring 58 has a split 59 which straddles the axial spline 44 of the coiled tubing end 40 when the end sub 54 is disposed within the coiled tubing end 40. Actuator ring 60 is rotatably mounted at thread 62 such that rotating ring 60 relative to mandrel 50 will advance actuator ring 60 in the direction of arrow 64. This axial movement advances seal ring 66 that holds a seal 68 against exterior wall 70 of the coiled tubing end 40. The seal 68 can be an o-ring or packing elements, bonded seals, cap seals, or t-seals, to name a few examples. The advancing seal ring 66, as shown in FIG. 1, with its split straddling spline 10 inside the coiled tubing, in the direction of arrow 64 expands the lock ring 58 up taper 56 and into contact with interior wall 42 for an anchor connection. Ramp 72 advances in the direction of arrow 64 as part of the radial movement of lock ring 58. Ramp 72 can have a ratchet on it so that reverse movement of ring 58 in a direction opposite arrow 64 is prevented. Alternatively, after putting the parts in the position of FIG. 3 a pin 36 can be inserted through an opening in actuator ring 60 and into mandrel 50.

The outer surface 70 at the end of the coiled tubing 40 can be prepared by removing burrs or surface irregularities with appropriate tools or even by sanding with sandpaper or a power sanding tool for a clean exterior finish. Since the surface preparation for the seal 68 is external the quality of the surface preparation can be readily seen. Additionally, for the smaller sizes there is no longer an access issue when trying to prepare an interior surface to accept a seal. The lock or anchor ring 58 can be made of connected segments with circumferential wickers 74 and axially oriented wickers 76 for torque resistance. In between is a relief groove 78. The connections between the segments of ring 58 can either extend or break as the seal ring 66 is advanced in the direction of arrow 64. A fishing neck 78 is provided on end sub 54 in the event of a separation that requires the tool (not shown) to be fished out.

Seal ring 66 defines an annular space 80 into which end 82 of coiled tubing 40 is advanced. Mandrel 50 supports ring 66. Seal 68 is preferably an o-ring in an associated groove 69 in ring 66.

The connection described above can be used in a wide variety of wellbore applications and treatments. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The above description is illustrative of the preferred embodiment and many modifications may be made by those skilled in the art without departing from the invention whose scope is to be determined from the literal and equivalent scope of the claims below:

We claim:

1. A connection for a borehole tool to a coiled tubing end, comprising:

the coiled tubing end having an interior surface with an inwardly-projecting spline which extends axially along said interior surface;

a mandrel having an end sub that extends into the coiled tubing end for anchoring to the interior surface and a seal ring which extends over said coiled tubing end for selectively sealing said mandrel to an outer surface of the coiled tubing end; and a lock ring having a split which straddles the spline when the end sub is within the coiled tubing end and which is expanded radially toward the interior surface upon a ramp of the mandrel to lock the mandrel within the coiled tubing end.

2. The connection of claim 1, wherein:

said mandrel further comprises a surrounding sleeve supported by said mandrel defining an annular space in between, said annular space adapted to accept the coiled tubing end.

3. The connection of claim 2, wherein:

said surrounding sleeve further comprises a seal extending into said annular space for said selective sealing to said outer surface of the coiled tubing end.

4. The connection of claim 3, wherein:

said seal comprises at least one o-ring in a groove.

5. The connection of claim 1, wherein:

one of said ramps is axially actuated by relative rotation of an exterior ring on said mandrel with respect to said mandrel.

6. A well treatment method using a tool connected to a coiled tubing end with a connector, comprising:

leaving in place a spline inside said coiled tubing end;

advancing a lock ring on said connector relatively to said spline when a lock ring is in a retracted position;

providing an axial split in said lock ring to straddle said spline during said advancing;

radially extending said lock ring into an inside wall of said coiled tubing end to secure said connector to said coiled tubing end.

7. The method of claim 6, comprising:

providing a spaced sleeve supported by a mandrel of said connector to define an annular space in between;

advancing a coiled tubing end into the annular space;

engaging a seal between said sleeve and said outer surface of said coiled tubing end by said advancing.

8. The method of claim 7, comprising:

providing an o-ring in a groove in said sleeve for sealing to the outer surface of said coiled tubing end.

9. The method of claim 6, comprising:

moving said connector to enter the coiled tubing end and span over the coiled tubing end at the same time;

anchoring said connector inside the coiled tubing end by radially extending;

sealing said connector to an outer surface of the coiled tubing end;

delivering fluid through the coiled tubing to said connector and to the tool.

10. The method of claim 9, comprising:

moving at least one of opposing wedges axially closer together for said radially extending said lock ring.

11. The method of claim 10, comprising:

providing axial and circumferential wickers on said lock ring.

12. The method of claim 9, comprising:

performing a well treatment with said delivering fluid.

13. The method of claim 12, comprising:

performing as said well treatment at least one of hydraulic fracturing, stimulation, tracer injection, cleaning, acidizing, steam injection, water flooding and cementing.

* * * * *